United States Patent [19]

Kuriyama et al.

[11] Patent Number: 4,972,855

[45] Date of Patent: Nov. 27, 1990

[54] SHREDDED TOBACCO LEAF PELLETS, PRODUCTION PROCESS THEREOF AND CIGARETTE-LIKE SNUFFS

[75] Inventors: Katsumi Kuriyama; Shigeru Ogawa, both of Koshigaya; Mizuho Ohtomo, Ageo; Kohichi Kuroda; Tadashi Saito, both of Tokyo, all of Japan

[73] Assignees: Dainichiseika Color & Chemicals Mfg. Co., Ltd.; Kowa Display Company, Inc., both of Tokyo, Japan

[21] Appl. No.: 343,371

[22] Filed: Apr. 26, 1989

[30] Foreign Application Priority Data

Apr. 28, 1988 [JP] Japan ..... 63-104026

[51] Int. Cl.[5] ..... A24B 3/14; A24B 15/14

[52] U.S. Cl. ..... 131/355; 131/375; 131/111; 131/77

[58] Field of Search ..... 131/355, 352, 77, 78, 131/375, 111, 370

[56] References Cited

U.S. PATENT DOCUMENTS

| | | | |
|---|---|---|---|
| 2,158,928 | 5/1939 | Deich | 131/348 X |
| 3,628,541 | 12/1971 | Buchmann | 131/355 |
| 3,968,804 | 7/1976 | Kelly et al. | 131/370 |
| 4,497,331 | 2/1985 | Nellen | 131/355 |
| 4,513,756 | 4/1985 | Pittman et al. | 131/111 |
| 4,625,737 | 12/1986 | Keritsis et al. | 131/355 |
| 4,655,231 | 4/1987 | Ray et al. | 131/352 X |
| 4,836,225 | 6/1989 | Sudoh | 131/355 X |

FOREIGN PATENT DOCUMENTS 275420 8/1951 Switzerland .

*Primary Examiner*—V. Millin
*Assistant Examiner*—Jennifer L. Doyle
*Attorney, Agent, or Firm*—Oblon, Spivak, McClelland, Maier & Neustadt

[57] ABSTRACT

A shredded tobacco leaf pellet is composed of tobacco leaf shreds bound together with a nicotine-non-absorptive thermoplastic binder while retaining air permeability. The pellet is produced by mixing tobacco leaf shreds and a nicotine-non-absorptive thermoplastic binder, forming the resultant mixture into a desired shape while retaining air permeability, and then subjecting the thus-formed mixture to a heat treatment. A cigarette-like snuff is composed of at least one shredded tobacco leaf pellet of the above-described type and an outer envelope surrounding the pellet therein.

10 Claims, 1 Drawing Sheet

SHREDDED TOBACCO LEAF PELLETS, PRODUCTION PROCESS THEREOF AND CIGARETTE-LIKE SNUFFS

BACKGROUND OF THE INVENTION

1. Field of the Invention:

This invention relates to shredded tobacco leaf pellets, a production process thereof and cigarette-like snuffs using one or more of the pellets, and more specifically has as a primary object the provision of cigarette-like snuffs which do not give unpleasant feeling or adverse influence such as smoke, offensive odor and/or ash to those around its inhaler and moreover does not substantially impair the health of its inhaler himself.

The term "shredded tobacco leaf pellet" as used herein means a pellet of tobacco leaf shreds. The word "pellet" should be interpreted in a broad sense so that the shredded tobacco leaf pellet may not be limited to any particular shape. Similarly, the term "shred" as used herein should not be interpreted to imply any particular shape or size for shredded tobacco leaves. Tobacco leaf shreds may hence be of any shape and any size so long as they can fulfill the above and other objects of this invention.

2. Description of the Prior Art:

Tobacco has been consumed in great quantity for many years. It is however accompanied by a problem that its smoke, odor, ash and the like give unpleasant feeling to nearby non-smokers. Tobacco is also a potential fire hazard because it always requires lighting. A further problem has come to the surface that the health of smokers is adversely affected by inhalation of carbon monoxide and tar which occur upon combustion of tobacco leaves.

As a method for overcoming the above-mentioned problems of tobacco and still drawing satisfaction from habitual or regular smokers, peppermint pipes and the like have conventionally been known as one kind of snuffs. These peppermint pipes and the like however do not contain various inherent and essential components of tobacco—led by nicotine—and cannot hence give feeling of smoking. For these reasons, they have not been accepted widely.

On the other hand, substitute cigarettes (for example, "Flavor", trade name for substitute cigarettes produced in U.S.A.) have also been known. They are produced by extracting and purifying nicotine which is a principal component of tobacco, causing a suitable carrier to bear nicotine and then inserting and holding it in a cigarette-shaped hollow cylinder, so that nicotine can be inhaled little by little upon inhalation. Reference may be had to U.S. Pat. Nos. 4,284,089; 4,393,884; 2,860,638; 3,280,823; 3,584,630; and 4,083,372; and Japanese Patent Application Laid-Open Nos. 254170/1986 and 271775/1986.

The above substitute cigarettes do not require lighting and do not give off any smoke. They have hence solved most of the problems of conventional cigarettes, while still giving feeling of smoking very close to conventional cigarettes. They are however insufficient in other trace components, aroma and the like of tobacco. They have hence not been able to substitute fully for conventional cigarettes.

With a view toward solving such problems as mentioned above, it has been attempted to develop a cigarette-like snuff by having nicotine contained in natural tobacco leaf shreds, forming the nicotine-containing shreds into a small cylindrical shape with a binder, and then holding the thus-formed shreds in a cigarette-shaped cylinder so that nicotine may be inhaled along with inherent trace components and aroma of cigarette to give feeling of smoking (Japanese Patent Application Laid-Open No. 185361/1988 published Jul. 30, 1988—corresponding to U.S. patent application Ser. No. 07/080,919 of Aug. 3, 1987, both, assigned commonly to the present applicants).

Cigarettes require mass production. The above-proposed technique requires a solvent and/or water upon binding of tobacco shreds with the binder. As a result, a drying step is needed, thereby raising problems such as quality modifications of tobacco leaf shreds and evaporation of nicotine and flavorings. The above proposed technique therefore does not permit mass production.

As a solventless process, there is a process in which a two-pack polyurethane resin is used. It is however difficult to control the reaction in this process, so that mass production is infeasible. In addition, the resulting pellets do not have sufficient air permeability.

As the most serious drawback common to the various conventional techniques described above, the nicotine contained in tobacco leaf shreds is absorbed quickly into the binder of the shredded tobacco leaf pellets so that the release of nicotine lasts in a short time. Accordingly, there is a substantial difference between the amount of nicotine released immediately after the production and that after the passage of time. Nicotine cannot therefore be released stably, leading to the drawback that they cannot be stored for an extended period of time. It is hence difficult to practice these conventional techniques.

It has hence been desired to develop a technique capable of providing, through mass production, cigarette-like snuffs which do not require lighting, form neither smoke nor ash, assure smooth release of nicotine even after stored over a long period of time, and can give stimulative or sedative effects similar to conventional tobacco or cigarettes.

SUMMARY OF THE INVENTION

The present inventors have carried out an extensive investigation to meet the above-described long standing desire in the present field of art and also to fulfill the above and objects of this invention.

In one aspect of this invention, there is thus provided a shredded tobacco leaf pellet comprising tobacco leaf shreds bound together with a nicotine-non-absorptive thermoplastic binder while retaining air permeability.

In another aspect of this invention, there is also provided a process for the production of a shredded tobacco leaf pellet, which comprising mixing tobacco leaf shreds and a nicotine-non-absorptive thermoplastic binder, forming the resultant mixture into a desired shape while retaining air permeability, and then subjecting the thus-formed mixture to a heat treatment.

In a further aspect of this invention, there is also provided a cigarette-like snuff comprising at least one shredded tobacco leaf pellet of the above-mentioned type and an outer envelope surrounding the pellet therein.

Upon formation of the tobacco leaf shreds into the desired shape while retaining air permeability, the nicotine-non-absorptive thermoplastic binder is mixed with the tobacco leaf shreds, the resultant mixture is formed into a green body of a relatively low density, and the green body is then subjected to the heat treatment to once soften or melt the binder to put the tobacco leaf shreds together. It is thus possible to mass-produce shredded tobacco leaf pellets and cigarette-like snuffs excellent in air permeability, nicotine releasability, strength and long-term storability, etc.

Shredded tobacco leaf pellets thus obtained may optionally be impregnated with nicotine, a flavoring, tobacco extract flavor or the like in an amount as needed. They stably retain the good releasability of nicotine even after stored for a long time. Their inhalation can therefore give sufficient feeling of smoking.

According to the present invention, the shredded tobacco leaf pellets capable of giving sufficient feeling of smoking without lighting can be provided through mass production. Further, when the shredded tobacco leaf pellets are impregnated with nicotine or the like, the impregnant is substantially unabsorbed in the binder. A substantial amount of nicotine can therefore be released continuously and stably by inhalation even after stored for a long time.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION AND PREFERRED EMBODIMENTS

Figure 1:
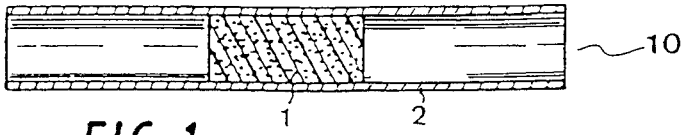
FIG. 1 is a longitudinal cross-sectional view of a snuff according to one embodiment of this invention.

The tobacco leaf shreds useful in the practice of this invention are, for example, tobacco leaf shreds obtained by cutting tobacco leaves into about 1 mm widths as employed conventionally in cigarettes and the like; or pulverized or ground tobacco leaves. They are called simply "tobacco leaf shreds" in this invention. Such conventionally-known tobacco leaf shreds are all usable in this invention. It is the primary purpose of the tobacco leaf shreds, which are to be employed in this invention, to give various inherent trace components of tobacco leaves to shredded tobacco leaf pellets. In addition, they also serve to give sufficient air permeability and strength to the shredded tobacco leaf pellets. Namely, it has been found that tobacco leaves are fibrous and contain a number of stomata, have excellent stability against pressure, heat, mechanical forces such as grinding, and upon formation into a desired shape, give superb shaping stability and impart excellent strength and air permeability as well as good retainability and releasability of nicotine, flavorings and the like.

It is the principal feature of this invention that the above-described tobacco leaf shreds are formed into a suitable shape with a specific binder without using a paper sheet, plastic film or the like and a nicotine-non-absorptive thermoplastic binder is used as the binder.

The term "nicotine-non-absorptive thermoplastic resin binder" as used herein means a thermoplastic resin in which nicotine is not dissolved or absorbed substantially. According to a detailed investigation by the present inventors, nicotine has strong dissolving action to organic substances. Most of various thermoplastic resins known to date absorb nicotine very well and scarcely release at room temperature the nicotine thus absorbed. It has however been found that ethylene-vinyl alcohol copolymers and polyamide resins have excellent nicotine non-absorptivity.

The ethylene-vinyl alcohol copolymers useful in the practice of this invention are saponification products of ethylene-vinyl acetate copolymers. Particularly preferred are those having an ethylene content of 20–60 mole % with the saponification degree of the remaining vinyl acetate units being at least 80%, preferably at least 90%. Needless to say, the above copolymers may contain a third comonomer to an extent not impairing the nicotine-non-absorptivity in this invention.

On the other hand, those preferred as polyamide resins are synthetic linear polyamide resins whose backbones are formed by a repetition of an amide bond (—CONH—), including for example ring-opening polymerization products of caprolactam, nylon 6 obtained by the polycondensation of 6-aminocaproic acid, nylon 66 and nylon 610 obtained by the polycondensation between hexamethylenediamine and dicarboxylic acids such as adipic acid and sebacic acid, nylon 11 obtained from 11-aminoundecanoic acid, and homopolymers and copolymers of nylon 12, etc.

Suitable binders such as those mentioned above can be used either singly or in combination. Other thermoplastic resins can also be used in combination to a small extent not impairing the above and other objects of this invention. As illustrative examples of the thermoplastic resins usable in combination, may be mentioned acrylic resins, vinyl chloride resins, chlorinated vinyl chloride resins, vinyl acetate resins, ester resins, urethane resins, alkyd resins, epoxy resins, amino resins, silicone resins, polyethylene resins, chlorinated polyethylene resins, cellulose resins, styrene resins, acrylonitrile resins, polyoxyethylene resins, xylene resins, toluene resins, coumarone resins, ketone resins, vinyl propionate resins, polypropylene resins, chlorinated propylene resins, polyvinyl butyrate resins, polyamide resins, vinylidene chloride resins, polycarbonate resins, polyterpene resins, polyvinyl alcohol, polyvinyl ether, maleic acid resins, polyvinyl pyrrolidone, cyclopentadiene resins, phenol resins, etc.

Exemplary synthetic rubbers may include SBR, BR, IR, NBR, CR, IIR, polybutene, polyisobutylene, chlorosulfonated polyethylene, epichlorohydrin rubber, etc.

As other natural rubbers, polymers and chemicals, may be mentioned cellulose-based materials such as cellulose acetate, cellulose nitrate, CMC, HPC, HEC, MC, EC, EHEC and CMEC, polyamino acid resins, gum arabic, ester gums, casein, guar gum, copal rubber, gelatin, hide glue, dammar gum, tragacanth gum, lactose, glucose, locust bean gum, rosin, lecithin, chitin, chitosan, albumin, carageenan gum, konjak mannan, alginic acid, starch, xanthane gum, dextrin, gluten, pullulan, pectin, dammar, etc.

Illustrative waxes may include bees wax, whale wax, shellac wax, carnauba, olicurie, candelilla, Japan wax, cane, montan, ozokerite, ceresin, paraffin, microcystalline wax, Fisher-Tropsch wax, polyethylene, polyethylene glycol, stearic acid, castor, opal, Acrawax (trade mark), Armowax (trade mark), stearamide, fatty acid amides, etc.

Besides, may also be mentioned surfactants such as glycerin fatty acid esters, acetic monoglyceride, lactic monoglyceride, citric monoglyceride, succinic monoglyceride, diacetyl tartaric monoglyceride, polyglycerin esters, polyglycerin polyricinoleate, sugar esters, sucrose acetoisobutyrate, sorbitan esters, propylene glycol esters, and calcium stearoylacetate; silicone oils; and plasticizers. They may be used singly or in combination, or as copolymers.

As a process for forming the tobacco leaf shreds into a desired shape with such a nicotine-non-absorptive thermoplastic binder as described above, may be mentioned the process which comprises mixing the tobacco leaf shreds and binder to have the binder adhered uniformly on the surfaces of the tobacco leaf shreds, forming the resultant mixture into the desired shape and then subjecting the thus-formed green body to a heat treatment of the process which comprises mixing a solution of the binder dissolved in a suitable solvent with the tobacco leaf shreds and then forming the resultant mixture into the desired shape. If the binder is used too little here, the resulting shredded tobacco leaf pellet will have sufficient strength although its air permeability will be sufficient. It is therefore not preferable to use the binder too little. If the binder is used too much on the other hand, the air permeability of the resulting shredded tobacco leaf pellet will be reduced although its strength will be sufficient. It is therefore not preferable to use the binder too much. Regarding the preferable amount of the binder, the weight ratio of the tobacco leaf shreds to the binder may preferably be in a range of from 100/200 to 100/20. In this range, the binder can impart sufficient air permeability and strength. Air permeability varies to a certain extent depending on the pressure at the time of forming. According to a detailed investigation by the present inventors, best results were obtained when the apparent density of the resulting pellet was controlled within 0.3–1.2 g/cc, preferably 0.3–0.9 g/cc. Namely, any apparent densities smaller than 0.3 g/cc were unable to provide sufficient strength, while any apparent densities greater than 1.2 g/cc led to insufficient air permeability.

Any forming method may be employed in this invention. However, the punching press method described in "Huntai (Powder) Handbook" (compiled by Japan Powder Industry Technology Association) is suitable for mass production. To conduct mass production by this method, it is preferable to mix tobacco leaf shreds and a binder at a preferable ratio into a uniform mixture and then to suitably loosen the mixture into particles so as to give a suitable degree of flowability. To impart such flowability, it was effective to use the tobacco leaf shreds and binder at such a ratio as described above. Upon forming, the above mixture is filled in a die of a punching press and then pressed and extruded by a punch into a desired shape. Since the strength of the thus-shaped mixture, namely, green body is insufficient in this state, the green body is subjected to a heat treatment at a temperature at which the binder thus employed is softened or fused. In this manner, the binder fully exhibits its binding force. Subsequent cooling can give sufficient strength. Conditions for the heat treatment vary depending of the kind and amount of the binder to be used. At about 100°–200° C., the heat treatment can be conducted sufficiently in several seconds to several hours in general.

No particular limitation is imposed on the shape of the shredded tobacco leaf pellets of this invention, which are obtained as described above. Preferred is a cylindrical shape having a diameter of about 5–10 mm or so. Its length may be determined suitable in accordance with the manner of its use.

The characteristic taste and aroma of tobacco can be sensed when such a shredded tobacco leaf pellet of this invention is held, for example, in a suitable cigarette-like cylinder and then inhaling it through the mouth. This form cannot however give sufficient feeling of smoking like inhalation of a conventional cigarette without lighting. It is therefore desirable to impregnate the heat-treated pellet with nicotine, a flavoring, tobacco extract flavor or a mixture thereof. Nicotine—a particularly important component—is a naturally occurring alkaloid and is obtained from tobacco leaves by extraction. Upon impregnation of shredded tobacco leaf pellets with nicotine, it is necessary to handle nicotine with sufficient care because inhalation of a great deal of nicotine at once causes a symptom of poisoning. It is preferable to mix nicotine in an amount of about 0.01–10 parts by weight per 100 parts by weight of tobacco leaf shreds. Because it is dangerous to add nicotine too much, the amount of nicotine to be added per piece of shredded tobacco leaf pellet may preferably be in a range not more than 10 mg, with 5 mg to 0.5 mg being more preferred. Further, upon use of the pellet, the amount of nicotine to be released per inhalation is not greater than 10 $\mu$g, preferably in a range of from 5 $\mu$g to 0.5 $\mu$g. Such an appropriate degree of nicotine release has been achieved for the first time by the present invention. Since nicotine is quickly absorbed in a binder in the conventional techniques, the impregnation of nicotine in a large amount is required. As a result, nicotine is released too much in an initial stage and in many instances, the amount of nicotine release drops to 0.5 $\mu$g or less in a short time. If nicotine is added too little, the feeling of smoking is insufficient. In contrast, the addition of nicotine in an excessively large amount is however hazardous.

In the further aspect of this invention, a cigarette-like snuff using the shredded tobacco leaf pellet described above is provided. Embodiments of this aspect will be described in detail with reference to the accompanying drawings.

Figure 3:
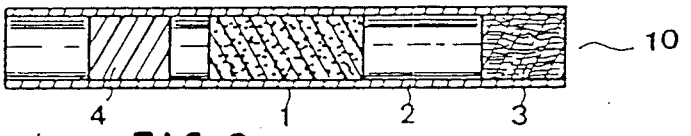
FIG. 3 is a longitudinal cross-sectional view of a snuff according to a further embodiment of this invention.
Figure 4:
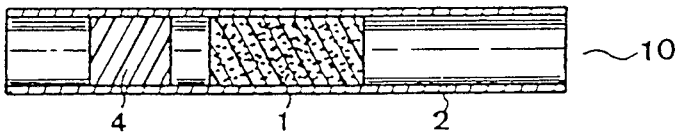
FIG. 4 is a longitudinal cross-sectional view of a snuff according to a still further embodiment of this invention.
Figure 5:
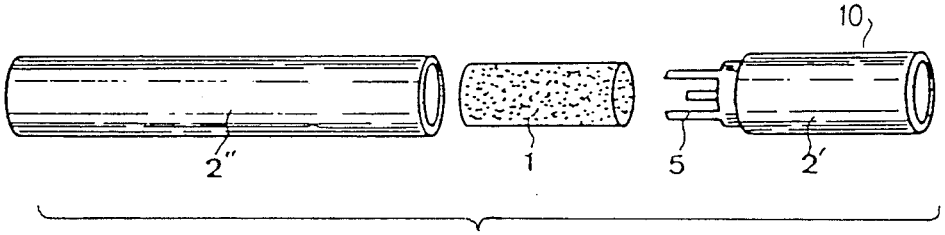
FIG. 5 is an exploded perspective view of a snuff according to a still further embodiment of this invention, in which a shredded tobacco leaf pellet is held in an outer cylindrical enclosure formed of two parts fitted releasably with each other.

FIGS. 1 through 4 illustrate in cross-section cigarette-like snuffs 10 of this invention respectively, while FIG. 5 is an exploded perspective view of a still further embodiment.

Figure 2:
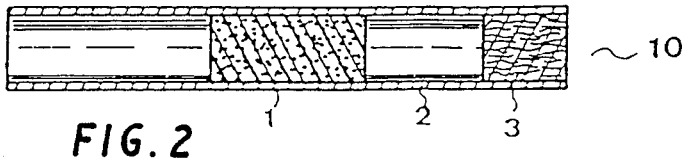
FIG. 2 is a longitudinal cross-sectional view of a snuff according to another embodiment of this invention.

As shown in FIGS. 1 through 5, the cigarettelike snuffs 10 according to this invention are each composed of the shredded tobacco leaf pellet 1 and an outer cylindrical enclosure 2 made of paper or a plastic and provided around the shredded tobacco leaf pellet 1. As shown in FIG. 2, a filter tip 3 which is of the same type as those employed in conventional cigarettes may be provided as illustrated in FIG. 2. As depicted in FIGS. 3 and 4, an air-permeable member 4 impregnated or coated with nicotine may also be provided in combination at a desired position. As a still further alternative, the outer cylindrical enclosure 2 may be divided into two parts 2', 2''. One of the parts, i.e., the part 2' is provided with a means 5 for holding the shredded tobacco leaf pellet 1 so that the shredded tobacco leaf pellet 1 is held in place within the part 2'. The part 2' with the pellet 1 held therein is releasably fit with the part 2'', thereby permitting replacement of the pellet 1 as needed. Use of the snuffs in the same manner as conventional cigarettes without lighting can give the feeling of smoking to the inhalers.

In the embodiments shown in FIGS. 3 and 4 respectively, it is preferable to arrange the nicotine impregnated or coated member 4 at a position somewhat set back inwardly from the free end of the outer cylindrical enclosure 2 so that the nicotine impregnated or coated member 4 is not brought into contact with the lips or tongue of an inhaler even if the inhaler accidentally takes the snuff on the side of the nicotine impregnated or coated member 4 in his mouth.

Although the snuffs of FIGS. 1, 2 and 5 can allow their inhalers to sense the taste and aroma of tobacco leaves, the inhalers cannot take nicotine, the principal component of tobacco, to sufficient extents from the shredded tobacco leaf pellets alone. It is hence preferable to add a suitable amount of nicotine in the shredded tobacco leaf pellet either during or after the production of the pellet. In the case of the embodiments shown in FIGS. 3 and 4, nicotine may optionally be incorporated in the shredded tobacco leaf pellets 1.

In order to prevent the shredded tobacco leaf pellet 1 impregnated or coated with nicotine from being brought into contact with the lips or tongue, it is also preferable to provide the filter tip 3 at one end or to leave some space in an end portion of the outer cylindrical member 2 in these cases, as shown in FIGS. 1 to 5. In each of the illustrated embodiments, one or more other flavorings and the like may be mixed upon formation of tobacco leaf shreds.

The present invention will hereinafter be described more specifically by the following Examples and Comparative Examples, in which all designations of "part" or "parts" and "%" means part or parts by weight and wt. % unless otherwise specifically indicated.

EXAMPLE 1

Ten parts of an ethylene-vinyl alcohol copolymer (hereinafter abbreviated as "EVOH") (proportion of copolymerized ethylene: 47 mole %; melting point: 156° C.) were added to a mixed solvent of 40 parts of ethyl alcohol, 25 parts of n-propyl alcohol and 25 parts of water, followed by stirring at 70°-80° C. for dissolution. After cooling the resultant solution to 30° C. or lower, the solution was dried in a spray drier to obtain EVOH powder (EVOH Powder-1).

Ten parts of tobacco leaf shreds, which had been sifted to 0.5 mm to 1.0 mm, were mixed with 12 parts of EVOH Powder-1. Into a cylindrical die of a forming machine of the punching press type, said die having an internal diameter of 7 mm and a length of 30 mm, the mixture was charged at a rate of 0.26 g. The mixture was shaped at 25° C. to obtain shredded tobacco leaf pellets having a diameter of 7 mm and a length of 8 mm.

The pellets were then subjected to a heat treatment at 170° C. for 10 minutes in a hot-air drier to obtain shredded tobacco leaf pellets (Pellet-1). Their apparent density was 0.85 g/cc. They were good in air permeability and also in both forming stability and strength.

EXAMPLE 2

Ten parts of an alcohol-soluble polyamide ("Platabond M1276", trade name; Nihon Rilsan K.K.; melting point: 115°) were dissolved in a mixed solvent of 65 parts of ethyl alcohol and 25 parts of water in a similar manner as in Example 1. The resultant solution was cooled, and particles thus precipitated were dried to obtain polyamide powder (PA Powder-1).

Ten parts of tobacco leaf shreds, which had been sifted to 0.5 mm to 1.0 mm, were mixed with 12 parts of EVOH Powder-1 and PA Powder-1. In a similar manner as in Example 1, the resultant mixture was charged at a rate of 0.245 g into the cylindrical die of the the forming machine. The mixture was shaped at 60° C. A heat treatment was conducted at 160° C. for 8 minutes to obtain shredded tobacco leaf pellets (Pellet-2) having an apparent density of 0.8 g/cc.

EXAMPLE 3

Ten parts of tobacco leaf shreds, 13 parts of PA Powder-1 and 2 parts of a vinyl acetate resin (softening point: 115° C.) were mixed at 140° C. to coat the tobacco leaf shreds with the resins. The resultant mixture was cooled to 25° C. or lower and then ground. The thus-ground product was sifted to obtain granules of 3 mm or smaller. The granules were shaped by a punching press which was equipped with a die having a diameter of 8 mm and a length of 35 mm, thereby obtaining green pellets having a diameter of 8 mm and a length of 10 mm. The green pellets were subjected to a heat treatment at 150° C. for 5 minutes in a similar manner as in Example 1, so that shredded tobacco leaf pellets (Pellet-3) of this invention were obtained. The thus-obtained shredded tobacco leaf pellets had an apparent density of 0.72 g/cc.

EXAMPLE 4

In a similar manner as in Example 1, fifteen parts of EVOH in which the proportion of copolymerized ethylene was 44 mole % were dissolved in a mixed solvent composed of 65 parts of ethyl alcohol and 20 parts of water to obtain a solution (EVOH Solution-2). After thoroughly mixing 100 parts of EVOH Solution-2 with 15 parts of tobacco leaf shreds whose sizes had been sifted 0.2 mm to 0.8 mm in advance, the resultant mixture was dried in vacuum while continuing its mixing. As a result, the ethyl alcohol and water were removed and the tobacco leaf shreds were coated with EVOH. In a similar manner as in Example 1, the resultant granules were charged at a rate of 0.184 g into the die of the forming machine and shaped at 23° C. to obtain green pellets having an apparent density of 0.6 g/cc. The green pellets were subjected to a heat treatment at 180° C. for 3 minutes in a similar manner as in Example 1, thereby obtaining shredded tobacco leaf pellets (Pellet-4) of this invention.

REFERENTIAL EXAMPLE 1

Ten parts of a low-molecular-weight polyethylene (melting point: 110° C.) were dissolved under heat at 120° C., to which 10 parts of tobacco leaf shreds were added. The resultant mixture was then mixed intimately. The thus-obtained mixture was cooled to 20° C. or lower and then ground. The thus-ground product was sifted to obtain granules whose sizes ranged from 0.8 mm to 4.0 mm.

The granules were then charged at a rate of 0.215 g into a cylindrical die of 7 mm across and 30 mm long of a punching press and shaped at 25° C. to obtain green pellets having a diameter of 7 mm and a length of 8 mm. Their apparent density was 0.7 g/cc. To increase the strength of the green pellets, the green pellets were subjected to a heat treatment at 120° C. for 3 minutes to obtain shredded tobacco leaf pellets (Pellet-5) as a comparative example.

REFERENTIAL EXAMPLE 2

In a similar manner as in Referential Example 1, fifteen parts of powder of EVOH (melting point: 90° C.) were mixed with 10 parts of tobacco leaf shreds whose sizes had been sifted 0.3 mm to 1.4 mm in advance, thereby obtaining green pellets. The green pellets were subjected to a heat treatment at 110° C. for 5 minutes to obtain shredded tobacco leaf pellets (Pellet-6) of this invention.

EXAMPLE 5

Pellet-1 to Pellet-6 were individually added and impregnated with 10 mg per pellet of nicotine of 98% or higher purity to provide samples for the measurement of amounts of nicotine to be released upon inhalation. Incidentally, with respect to Pellet-4, samples impregnated with 2 mg, 4 mg, 6 mg and 8 mg per pellet of nicotine respectively were prepared.

The measurement of the amount of released nicotine was conducted in the following manner. Each of the above samples was held in a TEFLON (trade mark) tube conforming in dimensions and shape with the sample. It was inhaled at an air draw rate of 35 cc per inhalation, namely, at a total air draw rate of 1,050 cc/min. The amount of nicotine released under the above conditions was measured by gas chromatography.

In addition, the air permeability of each shredded tobacco leaf pellet was measured by a permeability testing machine. Since the air permeability of "Mild Seven" produced by Japan Tobacco Inc. was 4.3 $cc/cm^2/sec$, this air permeability was assumed to be 10 for easier understanding and was compared to the air permeabilities of the shredded tobacco leaf pellets. Further, the strengths of the pellets were measured using a tablet breaking tester. The results of the above measurements are summarized in Table 1.

TABLE 1

| Pellet | Amount of nicotine impregnated | Amount of nicotine release after left over at 20° C. for 10 days | Amount of nicotine release after left over at 50° C. for 10 days | Air permeability | Strength | Absorption of nicotine | Dissolution in nicotine |
|---|---|---|---|---|---|---|---|
| Pellet-1 | 10 mg | 4 μg/2 μg | 4 μg/2 μg | 8 | 8 | None | None |
| Pellet-2 | 10 mg | 4 μg/2 μg | 4 μg/2 μg | 9 | 7 | None | None |
| Pellet-3 | 10 mg | 5 μg/3 μg | 5 μg/3 μg | 10 | 6 | None | None |
| Pellet-4 | 10 mg | 6 μg/4 μg | 6 μg/4 μg | 16 | 12 | None | None |
| Pellet-4 | 8 mg | 6 μg/3 μg | 6 μg/3 μg | 16 | 12 | None | None |
| Pellet-4 | 6 mg | 6 μg/2.5 μg | 6 μg/2.5 μg | 16 | 12 | None | None |
| Pellet-4 | 4 mg | 5 μg/2 μg | 5 μg/2 μg | 16 | 12 | None | None |
| Pellet-4 | 2 mg | 5 μg/1.5 μg | 5 μg/1.5 μg | 16 | 12 | None | None |
| Pellet-5 | 10 mg | 2 μg/1.2 μg | 0.2 μg/0.1 μg | 4 | 2 | Absorbed | None |
| Pellet-6 | 10 mg | 0.8 μg/0.2 μg | 0.02 μg/0.005 μg | 2 | 10 | Absorbed | Dissolved |

In Table 1, the amounts of nicotine release are values measured after leaving the respective pellets at 20° C. and 50° C. for 10 days after their impregnation with nicotine. Each amount of nicotine release is expressed by the average of the amount of nicotine release at the 100th inhalation and that at the 1,000th inhalation.

The absorption and dissolution of nicotine in each binder resin were expressed by indicating whether the nicotine contained as an impregnant in the corresponding shredded tobacco leaf pellet was absorbed in the binder of the pellet or the binder of the pellet was dissolved in the nicotine.

As is apparent from Table 1, Pellet-1 to Pellet-4 according to this invention which used binders not absorbing nicotine and not dissolved in nicotine did not show variations in the amounts of release at 20° C. and 50° C. The amounts of release remained stable over a long period of time. Even after left over at 50° C. for 10 days and moreover even at the 1,000th inhalation, those pellets released nicotine in the sufficiently large amounts respectively. They also had excellent air permeability and strength.

In contrast, in the case of Pellet-5 and Pellet-6 as comparative examples, the amount of nicotine release dropped sharply in a short time, thereby indicating the infeasibility of long-term storage.

EXAMPLE 6

A portion of the shredded tobacco leaf pellets immediately after their nicotine impregnation in Example 5 and those obtained after leaving portions of the pellets for 10 days at 20° C. and 50° C. respectively subsequent to the nicotine impregnation were individually held in polypropylene-made holders of the same type as that illustrated in FIG. 5, whereby cigarettelike snuffs according to this invention were produced. By three panellers A, B and C, the cigarette-like snuffs were tested with respect to the feeling of smoking. Those panellers were smokers who smoked about 20 cigarettes a day, and the test was conducted after prohibition against smoking for 3 hours. The results are summarized in Table 2.

TABLE 2

| Pellet | Amount of nicotine impregnated | Pellet I | | | Pellet II | | | Pellet III | | |
|---|---|---|---|---|---|---|---|---|---|---|
| | | A | B | C | A | B | C | A | B | C |
| Pellet-1 | 10 mg | ◎ | ◎ | ◎ | ◎ | ◎ | ◎ | ◎ | ◎ | ◎ |
| Pellet-2 | 10 mg | ◎ | ◎ | ◎ | ◎ | ◎ | ◎ | ◎ | ◎ | ◎ |
| Pellet-3 | 10 mg | ◎ | ◎ | ◎ | ◎ | ◎ | ◎ | ◎ | ◎ | ◎ |
| Pellet-4 | 10 mg | ◎ | ◎ | ◎ | ◎ | ◎ | ◎ | ◎ | ◎ | ◎ |
| Pellet-4 | 8 mg | ◎ | ◎ | ◎ | ◎ | ◎ | ◎ | ◎ | ◎ | ◎ |
| Pellet-4 | 6 mg | ◎ | ◎ | ◎ | ◎ | ◎ | ◎ | ◎ | ◎ | ◎ |
| Pellet-4 | 4 mg | ◎ | ◎ | ◎ | ◎ | ◎ | ◎ | ◎ | ◎ | ◎ |
| Pellet-4 | 2 mg | ◎ | ◎ | ◎ | ◎ | ◎ | ◎ | ◎ | ◎ | ◎ |
| Pellet-5 | 10 mg | ◎ | ◎ | ◎ | ○ | Δ | Δ | Δ | Δ | Δ |

TABLE 2-continued

| Pellet | Amount of nicotine impregnated | Pellet I | | | Pellet II | | | Pellet III | | |
|---|---|---|---|---|---|---|---|---|---|---|
| | | A | B | C | A | B | C | A | B | C |
| Pellet-6 | 10 mg | ◎ | ◎ | ◎ | Δ | X | X | X | X | X |

Pellet I: Pellets immediately after impregnation with nicotine.
Pellet II: Pellets left over at 20° C. for 10 days after impregnation with nicotine.
Pellet III: Pellets left over at 50° C. for 10 days after impregnation with nicotine.
◎: Feeling of smoking not different substantially from the conventional cigarettes.
○: Feeling of smoking not different substantially from the conventional cigarettes, but felt somewhat lighter.
Δ: Feeling of smoking was obtained to a some extent but was dissatisfactory.
X: No feeling of smoking was obtained practically.

We claim:

1. An air-permeable shredded tobacco leaf pellet for inhaling without lighting, said pellet having an apparent density of from 0.3 g/cc to 1.2 g/cc, comprising tobacco leaf shreds bound together with an ethylene-vinyl alcohol copolymer as a binder, and impregnated with nicotine, a flavoring or tobacco extract flavor, or a mixture thereof.

2. A process for the production of an air-permeable shredded tobacco leaf pellet for inhaling without lighting, said pellet having an apparent density of from 0.3 g/cc to 1.2 g/cc, which comprises:

mixing tobacco leaf shreds and an ethylene-vinyl alcohol copolymer as binder;

forming the resultant mixture into a desired shape while retaining air permeability;

subjecting the thus-formed mixture to a heat treatment to obtain a pellet preform; and impregnating the pellet preform with nicotine, a flavoring or tobacco extract, or a mixture thereof.

3. A cigarette-like snuff comprising at least one air-permeable shredded tobacco leaf pellet and an outer envelope surrounding the pellet therein, said pellet having an apparent density of from 0.3 g/cc to 1.2 g/cc, comprising tobacco leaf shreds bound together with an ethylene-vinyl alcohol copolymer as a binder, and impregnated with nicotine, a flavoring or tobacco extract flavor, or a mixture thereof.

4. The pellet of claim 1 wherein the copolymer binder has an ethylene content of 20–60 mole %.

5. The process of claim 2 wherein the copolymer binder has an ethylene content of 20–60 mole %.

6. The snuff of claim 3 wherein the copolymer binder has an ethylene content of 20–60 mole %.

7. The pellet of claim 4 wherein the copolymer binder is a saponification product of an ethylene-vinyl acetate copolymer with a saponification degree of at least 80%.

8. The process of claim 5 wherein the copolymer binder is a saponification product of an ethylene-vinyl acetate copolymer with a saponification degree of at least 80%.

9. The snuff of claim 6 wherein the copolymer binder is a saponification product of an ethylene-vinyl acetate copolymer with a saponification degree of at least 80%.

10. The process as claimed in claim 2, wherein the forming is conducted by a punching press.

* * * * *